US009527188B2

(12) United States Patent
Huang et al.

(10) Patent No.: US 9,527,188 B2
(45) Date of Patent: Dec. 27, 2016

(54) GRINDING WHEEL FOR WAFER EDGE TRIMMING

(71) Applicant: TAIWAN SEMICONDUCTOR MANUFACTURING COMPANY, LTD., Hsinchu (TW)

(72) Inventors: Xin-Hua Huang, Xihu Township (TW); Ping-Yin Liu, Yonghe (TW); Yuan-Chih Hsieh, Hsinchu (TW); Lan-Lin Chao, Sindian (TW); Chia-Shiung Tsai, Hsinchu (TW)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 46 days.

(21) Appl. No.: 13/629,889

(22) Filed: Sep. 28, 2012

(65) Prior Publication Data

US 2014/0051336 A1 Feb. 20, 2014

Related U.S. Application Data

(60) Provisional application No. 61/684,025, filed on Aug. 16, 2012.

(51) Int. Cl.

| | |
|---|---|
| ***B24B 9/06*** | (2006.01) |
| ***B24D 7/18*** | (2006.01) |
| ***B24B 1/04*** | (2006.01) |

(52) U.S. Cl.

CPC . *B24D 7/18* (2013.01); *B24B 1/04* (2013.01); *B24B 9/065* (2013.01)

(58) Field of Classification Search

CPC ..... B24B 1/00; B24B 7/228; B24B 9/06; B28D 5/021

USPC ..... 451/548, 44, 43; 125/20

See application file for complete search history.

(56) References Cited

U.S. PATENT DOCUMENTS

| | | | | |
|---|---|---|---|---|
| 1,825,277 | A * | 9/1931 | Lytle | 408/1 R |
| 2,942,387 | A * | 6/1960 | Lindblad | 451/548 |
| 2,996,061 | A * | 8/1961 | Miller | 408/59 |
| 4,541,758 | A * | 9/1985 | Frank et al. | 408/1 R |
| 4,625,707 | A * | 12/1986 | Whittaker | 125/20 |
| 4,843,766 | A * | 7/1989 | Umeda | 451/69 |
| 4,911,253 | A * | 3/1990 | Cliche | 175/213 |
| 5,341,606 | A * | 8/1994 | Hirabayashi | 451/41 |
| 5,934,976 | A * | 8/1999 | Makino et al. | 451/28 |
| 6,341,999 | B1 * | 1/2002 | Ohmori et al. | 451/44 |
| 7,204,244 | B1 * | 4/2007 | Pedersen | 125/20 |

FOREIGN PATENT DOCUMENTS

| | | |
|---|---|---|
| JP | 6-339847 | 12/1994 |
| JP | 11-245169 | 9/1999 |
| JP | 2009-224496 | 10/2009 |

OTHER PUBLICATIONS

Office Action dated Mar. 13, 2015 from corresponding No. TW 102126605.

* cited by examiner

*Primary Examiner* — Robert Rose
(74) *Attorney, Agent, or Firm* — Hauptman Ham, LLP

(57) ABSTRACT

A grinding wheel for wafer edge trimming includes a head having an open side and an abrasive end bonded around an edge of the open side of the head. The abrasive end is arranged to have multiple simultaneous contacts around a wafer edge during the wafer edge trimming.

20 Claims, 3 Drawing Sheets

GRINDING WHEEL FOR WAFER EDGE TRIMMING

TECHNICAL FIELD

The present disclosure relates generally to an integrated circuit and more particularly to a grinding wheel for wafer edge trimming.

BACKGROUND

In some integrated circuit fabrications, a wafer is trimmed on the edge to reduce damage to the wafer during processing such as thinning. However, during the edge trimming, the wafer can suffer from chipping, cracking, or other damages. Also, some edge trimming blades have short lifetime and low yield due to damages.

BRIEF DESCRIPTION OF THE DRAWINGS

Reference is now made to the following descriptions taken in conjunction with the accompanying drawings, in which.

DETAILED DESCRIPTION

Figure 1B:
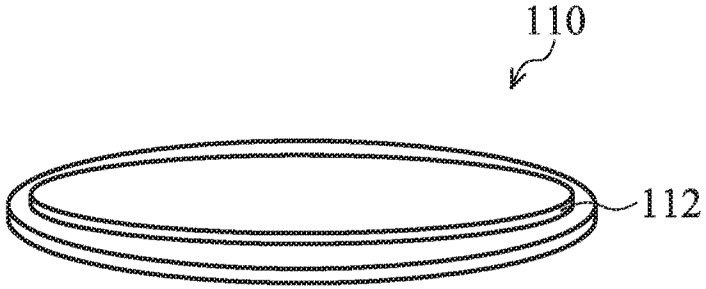
FIG. 1B is a schematic diagram of an exemplary wafer after wafer edge trimming using the grinding wheel in FIG. 1A according to some embodiments.

The making and using of various embodiments are discussed in detail below. It should be appreciated, however, that the present disclosure provides many applicable inventive concepts that can be embodied in a wide variety of specific contexts. The specific embodiments discussed are merely illustrative of specific ways to make and use, and do not limit the scope of the disclosure.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "over," "below," "beneath," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

Figure 1A:
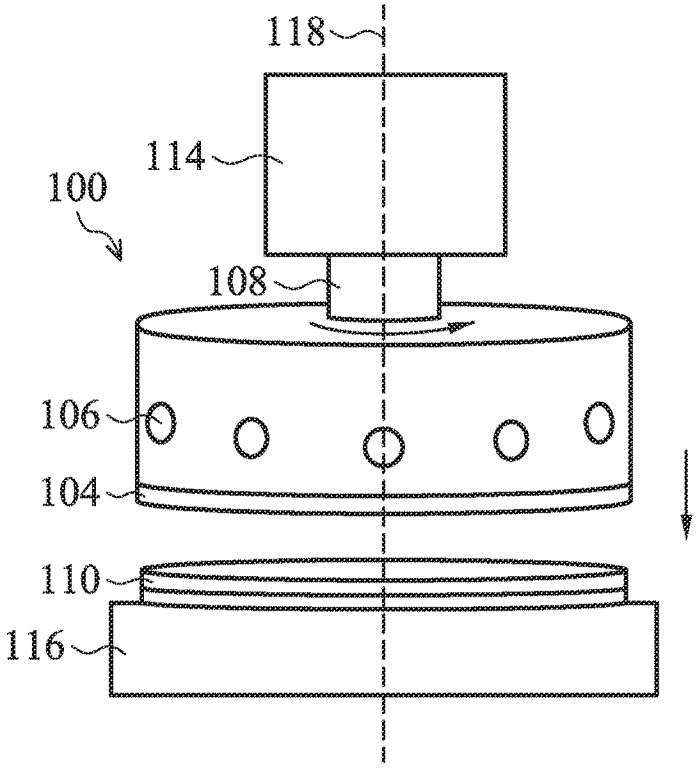
FIG. 1A is a schematic diagram of an exemplary grinding wheel for wafer edge trimming according to some embodiments.

FIG. 1A is a schematic diagram of an exemplary grinding wheel 100 for wafer edge trimming according to some embodiments. The grinding wheel 100 has a head 102, an abrasive end 104, and a rotation axis 108 on top of the head 102. In some embodiments, the head 102 is cup-shaped. The head 102 has its open side toward a wafer 110 in FIG. 1A.

The wafer 110 has multiple layers according to some embodiments, such as a carrier wafer and a device wafer, bonded together. The wafer 110 may comprise silicon, silicon dioxide, aluminum oxide, sapphire, germanium, gallium arsenide (GaAs), an alloy of silicon and germanium, indium phosphide (InP), and/or any other suitable material.

The head 102 comprises stainless steel, aluminum, any combination thereof, or any other suitable material that can provide sufficient mechanical rigidity and strength for edge trimming. The head 102 and the abrasive end 104 are bonded with bonding material comprising ceramic, resin, rubber, any combination thereof, or any other suitable material.

The abrasive end 104 is bonded around the edge of the open side of the head 102. The abrasive end 104 is arranged to have multiple simultaneous contacts around the edge of the wafer 110 when the grinding wheel 100 is moved to contact the wafer 110 for edge trimming. The abrasive end 104 has a diameter equal to the diameter of the wafer 110 to be trimmed, and a height of inside the grinding wheel 100 is equal a thickness of the wafer 110 in some embodiments. In some examples, the diameter of the abrasive end 104 of the grinding wheel 100 is 8 inches or 12 inches and the height of inside the grinding wheel 100 is about 750 μm. In other embodiments, the height of inside the grinding wheel 100 can be less or greater than the thickness of the wafer 110.

The abrasive end 104 comprises diamond, cubic carbon nitride (CBN), SiC, any combination thereof, or any other suitable material. In some other embodiments, the abrasive end 104 may have wavy, saw tooth, or other shapes with multiple protruding points of contact around the edge of the head 102, to have multiple simultaneous contacts with the edge of the wafer 110.

The grinding wheel 100 has generally uniform contacts around the edge of the wafer 110 with a larger contact area compared to some other grinding wheels or blades with limited local contact during edge trimming. Thus, the grinding wheel 100 applies globally uniform force to the edge of the wafer 110, which provides more stable and reliable edge trimming results with higher yield, i.e., wafer per hour (WPH), compared to some other methods. By using the grinding wheel 100, a local concentration of applied force on the edge of the wafer 110 is reduced by increasing the contact area around the edge of the wafer 110.

There are openings (e.g., holes) 106 on a body of the head 102 on for example, a sidewall. The openings 106 provide flow channels for debris from the edge trimming, e.g., the removed material, abrasives, and/or slurry ($SiO_2$, $CeO_2$ and other compound of these elements). This reduces wear on the grinding wheel 100 from debris stuck between the wafer 110 and the grinding wheel 100.

The grinding wheel 100 is fixed on a rotation module 114. The rotation axis 108 is used to fix and rotate the grinding wheel 100. The rotation module 114 moves the grinding wheel 100 toward the wafer 110 and rotates the grinding wheel 100 for edge trimming. The grinding wheel 100 has a concentric axis 118 with the wafer 110 for rotation during edge trimming. This provides more stability compared to other methods where the grinding wheel 100 and the wafer have perpendicular axes.

The wafer 110 is fixed (e.g., mounted) on a wafer mounting module 116 for wafer edge trimming. The grinding wheel 100 provides a relatively uniform force around the edge of the wafer 110. This helps more efficient edge trimming process compared to some other single ended or local force wafer edge trimming wheels or blades.

The rotation module 114 or the wafer mounting module 116 also provides ultrasonic vibration in some embodiments. The openings 106 and the ultrasonic vibration provide more efficient removal of debris that may be stuck between the wafer 110 and the abrasive end 104 and reduce damage to the wafer 110 surface during the wafer edge trimming process.

Also, the abrasive end 104 may have a self-sharpening effect while removing the debris through the openings 106 with ultrasonic vibrations. This in turn may improve the efficiency of edge trimming. In some examples, the WPH improved over 36 times when using the grinding wheel 100 with ultrasonic vibrations on the wafer 110, compared to other methods.

FIG. 1B is a schematic diagram of an exemplary wafer 110 after wafer edge trimming using the grinding wheel in FIG. 1A according to some embodiments. The wafer 110 shows the trimmed edge 112.

Figure 2B:
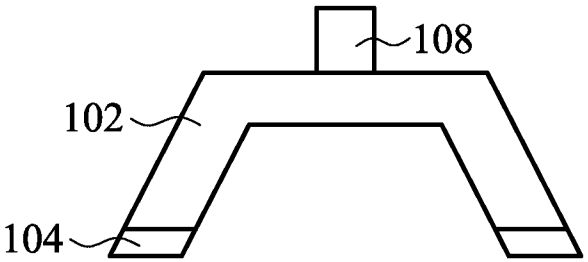
FIG. 2B is a cross section of another exemplary grinding wheel according to some embodiments.
Figure 2A:
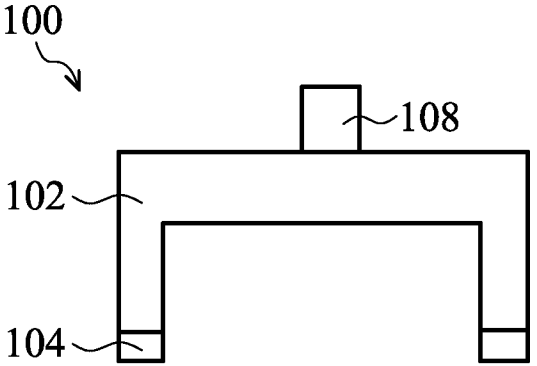
FIG. 2A is a cross section of the exemplary grinding wheel in FIG. 1A according to some embodiments.

FIG. 2A is a cross section of the exemplary grinding wheel 100 in FIG. 1A according to some embodiments. The head 102 in FIG. 2A has a rectangular cross section with the bottom side open. The abrasive end 104 is bonded to the bottom of the head 102. The rotation axis 108 is on top of the head 102 for fixing and rotating the grinding wheel 100.

FIG. 2B is a cross section of another exemplary grinding wheel according to some embodiments. The head 102 in FIG. 2B has a symmetric trapezoid cross section with the broadening bottom side being open. According to one or more embodiments, a diameter of the inside of the head 102 increases in a direction towards the bottom open side of the head 102, creating sloped sidewalls of the head 102. Also, the abrasive end 104 has a parallelogram shape as an extension of the sloped sidewalls of the head 102.

Figure 2C:
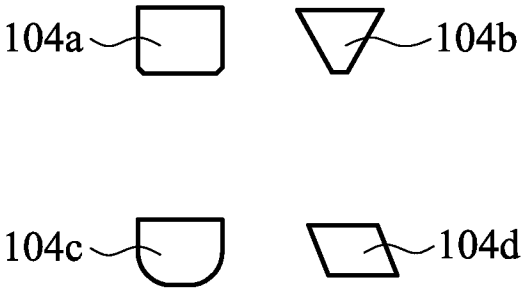
FIG. 2C is a cross section of an exemplary abrasive end of the grinding wheel in FIG. 1A according to some embodiments.

FIG. 2C is a cross section of exemplary abrasive end 104 of the grinding wheel in FIG. 1A according to some embodiments. The grinding wheel 100 can have a different end geometry that helps stabilize the contact area and provide to cushion to the impact during edge trimming. The abrasive end 104 has a cross section of a rectangular shape 104*a*, a triangular shape 104*b* (with chamfered or beveled end point), a round shape 104*c*, or a parallelogram shape 104*d* in some embodiments. In other embodiments, any other suitable shapes can be used.

Figure 3:
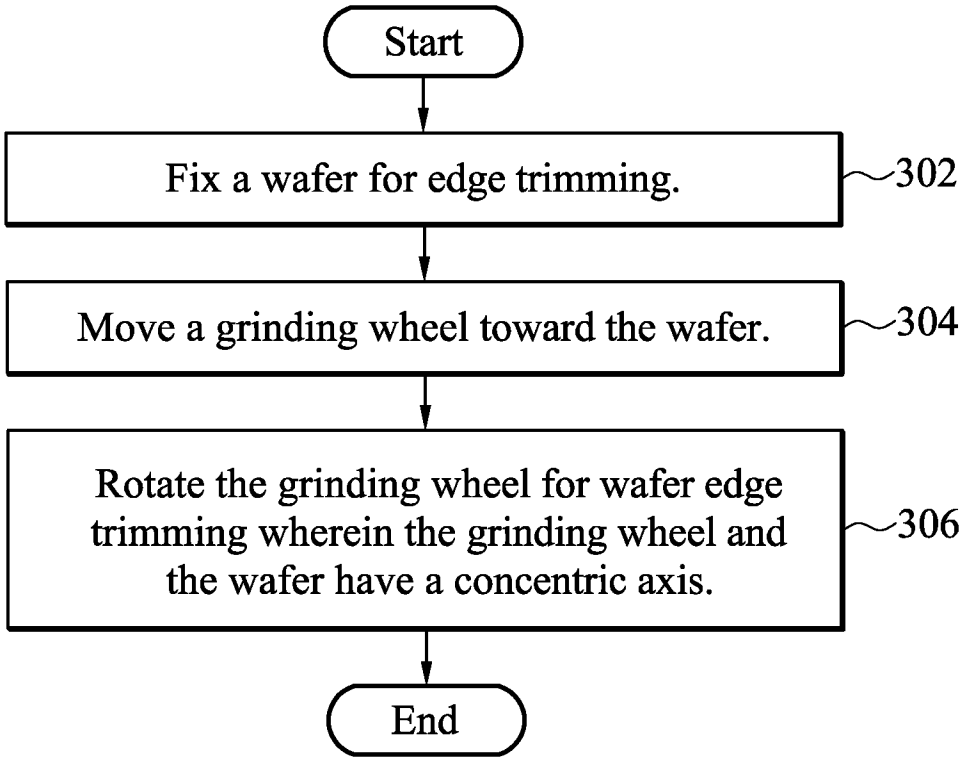
FIG. 3 is a flowchart of a method of wafer edge trimming using the grinding wheel in FIG. 1A according to some embodiments.

FIG. 3 is a flowchart of a method of wafer edge trimming using the grinding wheel 100 in FIG. 1A according to some embodiments. At step 302, a wafer is fixed on a wafer mounting module for edge trimming. At step 304, a grinding wheel is moved toward the wafer. At step 306, the grinding wheel is rotated for wafer edge trimming, where the grinding wheel and the wafer have a concentric axis.

In various embodiments, ultrasonic vibration is provided to the wafer or the grinding wheel. Debris from the edge trimming is removed through at least one opening on a sidewall of the grinding wheel. The grinding wheel is fixed on a rotation module. The grinding wheel includes a head and an abrasive end bonded to the head. The abrasive end is arranged to have multiple simultaneous contacts around a wafer edge. The abrasive end has a diameter equal to a wafer diameter to be trimmed.

In various embodiments, the abrasive end comprises diamond, cubic carbon nitride (CBN), SiC, or any combination thereof. The head comprises stainless steel, aluminum, or any combination thereof. The head and the abrasive end are bonded with a bonding material comprising ceramic, resin, rubber, or any combination thereof.

According to some embodiments, a grinding wheel for wafer edge trimming includes a head having an open side and an abrasive end bonded around the edge of the open side of the head. The abrasive end is arranged to have multiple simultaneous contacts around a wafer edge during the wafer edge trimming.

According to some embodiments, a method of wafer edge trimming includes fixing a wafer for edge trimming. A grinding wheel is moved toward the wafer. The grinding wheel is rotated for wafer edge trimming where the grinding wheel and the wafer have a concentric axis.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the process, machine, manufacture, and composition of matter, means, methods and steps described in the specification. As one of ordinary skill in the art will readily appreciate from the disclosed embodiments, processes, machines, manufacture, compositions of matter, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A grinding wheel for wafer edge trimming, comprising:

a head, cup-shaped in cross-section, having a sloped sidewall with respect to an axis of rotation of the head, the sidewall having an edge defining an open end of a cavity within the head, the sidewall having a plurality of openings therein, and the sidewall having a first diameter at the edge of the sidewall defining the open end and a second diameter at a location of the sidewall within the cavity, the second diameter being less than the first diameter; and an abrasive end bonded around the edge of the sidewall defining the open end of the head, an outer surface of a sidewall of the abrasive end being co-planar with an outer surface of the sidewall of the head, wherein the abrasive end is arranged to have multiple simultaneous contacts around a wafer edge during the wafer edge trimming, the head is substantially rigid and comprises a metal material, and a surface of the abrasive end is shaped to cushion an impact with the wafer.

2. The grinding wheel of claim 1, further comprising a shaft on top of the head.

3. The grinding wheel of claim 1, wherein the abrasive end comprises diamond, cubic carbon nitride (CBN), SiC, or any combination thereof.

4. The grinding wheel of claim 1, wherein the metal material comprises stainless steel, aluminum, or any combination thereof.

5. The grinding wheel of claim 1, wherein the head and the abrasive end are bonded with a bonding material comprising ceramic, resin, rubber, or any combination thereof.

6. The grinding wheel of claim 1, wherein the abrasive end has a cross section of a rectangular, triangular, round, or parallelogram shape.

7. A method of wafer edge trimming, comprising:

fixing a wafer for edge trimming, wherein the wafer has a diameter and the wafer has a center axis perpendicular to a non-edge surface of the wafer;

moving a cup-shaped grinding wheel toward the non-edge surface of the wafer, wherein the grinding wheel has a rotational axis concentric with the center axis of the wafer, and the grinding wheel is moved along the rotational axis;

contacting the non-edge surface of the wafer with an abrasive end of the grinding wheel, the grinding wheel comprising a substantially rigid metal portion and the abrasive end, wherein an outer surface of a sidewall of the abrasive end is co-planar with an outer surface of the grinding wheel and the abrasive end of the grinding wheel comprises a cross-sectional shape configured to cushion an impact on the wafer during the wafer edge trimming; and rotating the grinding wheel for the wafer edge trimming.

8. The method of claim 7, further comprising providing ultrasonic vibration of the wafer.

9. The method of claim 7, further comprising providing ultrasonic vibration of the grinding wheel.

10. The method of claim 7, further comprising fixing the grinding wheel on a rotation module.

11. The method of claim 7, wherein the abrasive end is arranged to have multiple simultaneous contacts around a wafer edge during the wafer edge trimming.

12. The method of claim 7, wherein the abrasive end has a diameter equal to the diameter of the wafer.

13. The method of claim 7, wherein the abrasive end comprises diamond, cubic carbon nitride (CBN), SiC, or any combination thereof.

14. The method of claim 7, wherein the metal comprises stainless steel, aluminum, or any combination thereof.

15. The method of claim 7, wherein the substantially rigid metal portion and the abrasive end are bonded with a bonding material comprising ceramic, resin, rubber, or any combination thereof.

16. A grinding wheel for wafer edge trimming, comprising:

a head, cup-shaped in cross-section, having a sloped sidewall with respect to an axis of rotation of the head, the sidewall having an edge defining an open end of a cavity within the head, and the sidewall having a first diameter at the edge of the sidewall defining the open end and a second diameter at a location of the sidewall within the cavity, the second diameter being less than the first diameter; and a shaft on top of the head; and an abrasive end bonded around the edge of the sidewall defining the open end of the head, an outer surface of a sidewall of the abrasive end being co-planar with an outer surface of the sidewall of the head, wherein the abrasive end is arranged to have multiple simultaneous contacts around a wafer edge during the wafer edge trimming, the head is substantially rigid and comprises a metal material, and the abrasive end is shaped to cushion an impact with a non-edge surface of the wafer.

17. The grinding wheel of claim 1, wherein a cross-sectional shape of the abrasive end is dependent on an angle of the slope of the sidewall with respect to the rotation axis.

18. The grinding wheel of claim 1, wherein a height of the abrasive end is about equal to a thickness of a wafer to be trimmed by the grinding wheel.

19. The method of claim 7, wherein upon contacting the wafer, the abrasive end applies a uniform force to the non-edge surface of the wafer.

20. The grinding wheel of claim 1, wherein the head exposes an entirety of an exterior sidewall of the abrasive end.

* * * * *